United States Patent [19]

Vaniglia

[11] 4,061,136

[45] Dec. 6, 1977

[54] PORTABLE WASHER AND MASSAGER APPARATUS FOR BATHTUBS

[76] Inventor: Giuseppe Vaniglia, 5205 W. 87th St., Oak Lawn, Ill. 60459

[21] Appl. No.: 721,959

[22] Filed: Sept. 9, 1976

[51] Int. Cl.[2] ..... A61H 29/00

[52] U.S. Cl. ..... 128/24.1; 128/56; 128/65; 4/184

[58] Field of Search ..... 128/65, 66, 24.3, 56; 4/184, 158

[56] References Cited

U.S. PATENT DOCUMENTS

| | | | |
|---|---|---|---|
| 727,993 | 5/1903 | Newport | 4/184 |
| 1,314,525 | 9/1919 | Kurth | 4/158 |
| 3,091,776 | 6/1963 | Roberts | 4/158 |
| 3,802,421 | 4/1974 | Williams | 128/56 |

*Primary Examiner*—Lawrence W. Trapp
*Attorney, Agent, or Firm*—Merriam, Marshall & Bicknell

[57] ABSTRACT

A portable, power driven washer and massager apparatus for use with bathtubs, including a pair of roller brushes rotary driven by an electric motor, heater and blower apparatus for directing hot air to the user, and means for readily mounting and dismounting the apparatus to a bathtub, including adjustable locking means with suction cups.

10 Claims, 6 Drawing Figures

PORTABLE WASHER AND MASSAGER APPARATUS FOR BATHTUBS

This invention relates to portable body washer and massager apparatus and particularly to a portable, power driven unit for use with any standard bathtub.

BACKGROUND OF THE INVENTION

Reference may be made to the following U.S. Pat. Nos. 727,993; 3,196,867; 3,359,572; 3,372,604; 3,529,593; and 3,802,421.

It is desired to provide an electrically driven portable device which can be readily removably mounted on any standard bathtub so as to be usable by a person for washing and massaging. Several complicated devices have been proposed in the past which may be temporarily attached to a bathtub and wherein the included rollers or brushes may be manually rotated by the user operating a hand crank with the crank drivenly connected to the brushes through gears and chains. While such hand cranked units may be suitable under normal conditions, they are not operable or desirable for use by the aged, or handicapped persons and children, wherein it is more desirable to provide for such persons a power or motor driven brush.

Power driven brushes for washing or massaging a person in a bathtub have normally utilized large and bulky fixed or non-portable units permanently mounted to or formed in combination with the tub. An electric motor is normally shielded from the water by permanently mounting it under and otherwise surrounded by the tub walls with the driving connection to the brushes being supplied through shafts supported by bearings mounted in the tub walls. Other power or motor driven brush units have been proposed, however they illustrate the common problem of attempting to provide a unit which is safe enough to operate in the vicinity of water and yet which will be a portable, power driven unit readily removable from the bathtub and usable with any standard tub.

SUMMARY OF THE INVENTION

In accordance with the principles of the present invention, there is provided a portable, lightweight unit including an L-shaped enclosure having a first portion extending over the bathtub and a rotating brush assembly mounted to project from the first portion so as to depend downwardly into the tub, and a second enclosure portion at right angles to the first portion positionable immediately adjacent the outside surface of an outer tub wall. The two portions of the L-shaped enclosure define an inner chamber protected from any water splashing during normal use of the unit. Within the enclosed chamber there is mounted an electric motor and drive means rotatably interconnecting the motor with a pair of roller brushes. An adjustable suction cup locking arrangement on the unit portion projecting into the tub securely engages the opposing inner surface of the tub to maintain the unit steady and in a locked position when placed on the tub in preparation for operation.

A heater and blower apparatus including an electric heater element is mounted within the enclosure with an outlet in one wall of the enclosure enabling directing of hot air to the user for aiding in massaging or drying. In an important aspect of the invention, the unit is constructed of lightweight material enabling its ready portability and implacement on any standard bathtub prior to use. After the unit is plugged into a standard electrical outlet, and the adjustable suction cup locks adjusted in position for steadying the unit, the apparatus is ready for operation. Removal of the unit for normal cleaning of the bathroom area can be readily accomplished by shutting down the unit, unplugging it from the power source, and loosening the adjustable locking mechanism. The unit is extremely lightweight and can be removed from the tub by grasping a handle which is provided and carrying it away.

DETAILED DESCRIPTION

Figure 1:
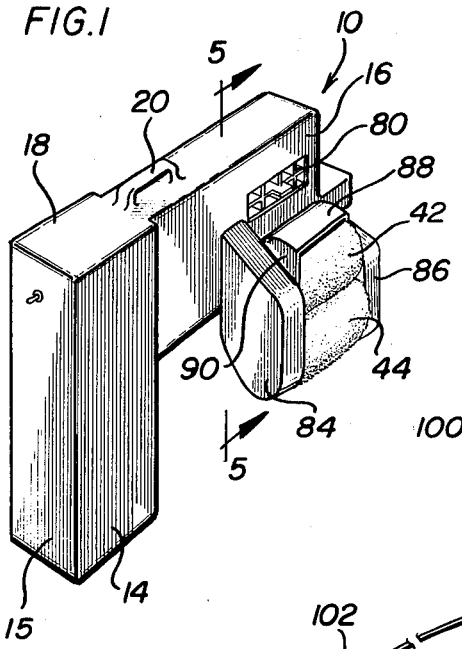
FIG. 1 is a perspective view illustrating a portable washer and massager apparatus in accordance with the present invention.
Figure 2:
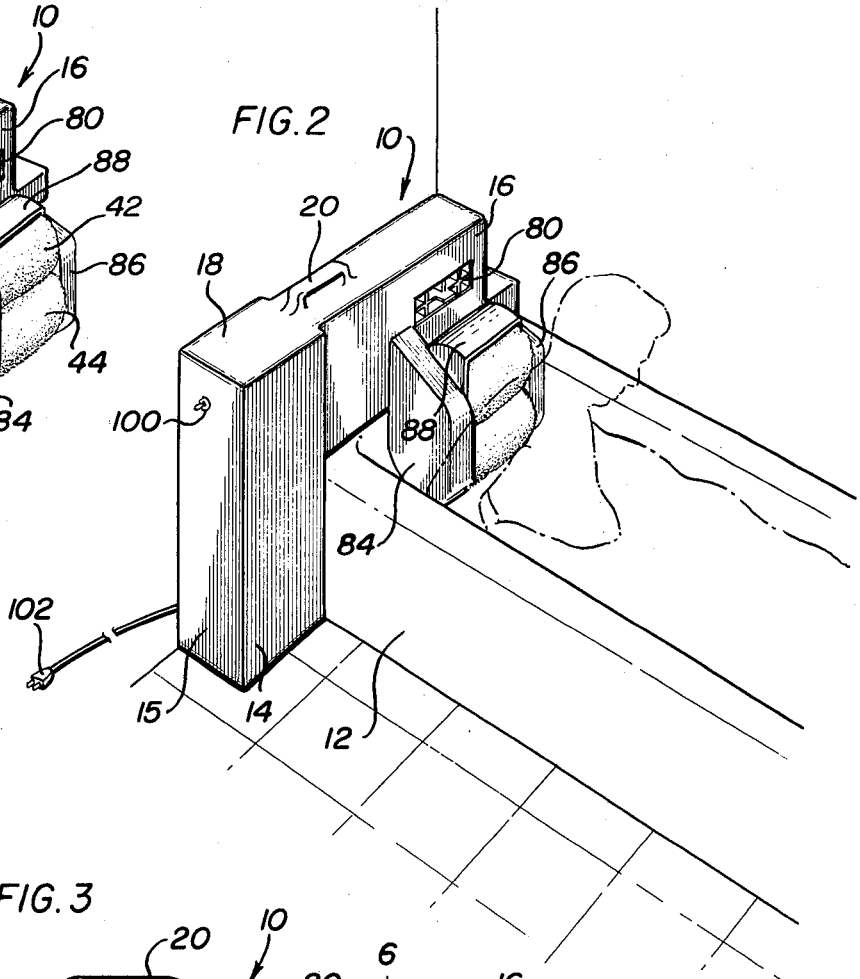
FIG. 2 is a partial perspective view of the apparatus of FIG. 1 removably mounted on a bathtub for washing and massaging an individual shown in dashed lines.

Referring now to FIG. 1, there is illustrated a lightweight, portable body washer and massager apparatus 10 which can be readily removably mounted for use in a bathtub 12 as shown in FIG. 2. The portable unit 10 includes an outer L-shaped enclosure having a vertical portion 14 adapted for placement next to the outside surface of the tub 12 and a horizontal portion 16 adapted to extend across the width of the tub as shown in FIG. 2. The enclosure further includes a top portion 18 with a handle 20 enabling the unit to be readily inserted in place and carried away from the tub when not in use, and a back cover 22. The vertical portion 14, horizontal portion 16, top 18 and back cover 22 define an enclosed chamber 23 for mounting the power elements protected from any water splashes during operation. It is preferred that all of the enclosure portions except the back cover are of unitary one-piece construction to reliably ensure that the chamber 23 is splash-proof.

Figure 4:
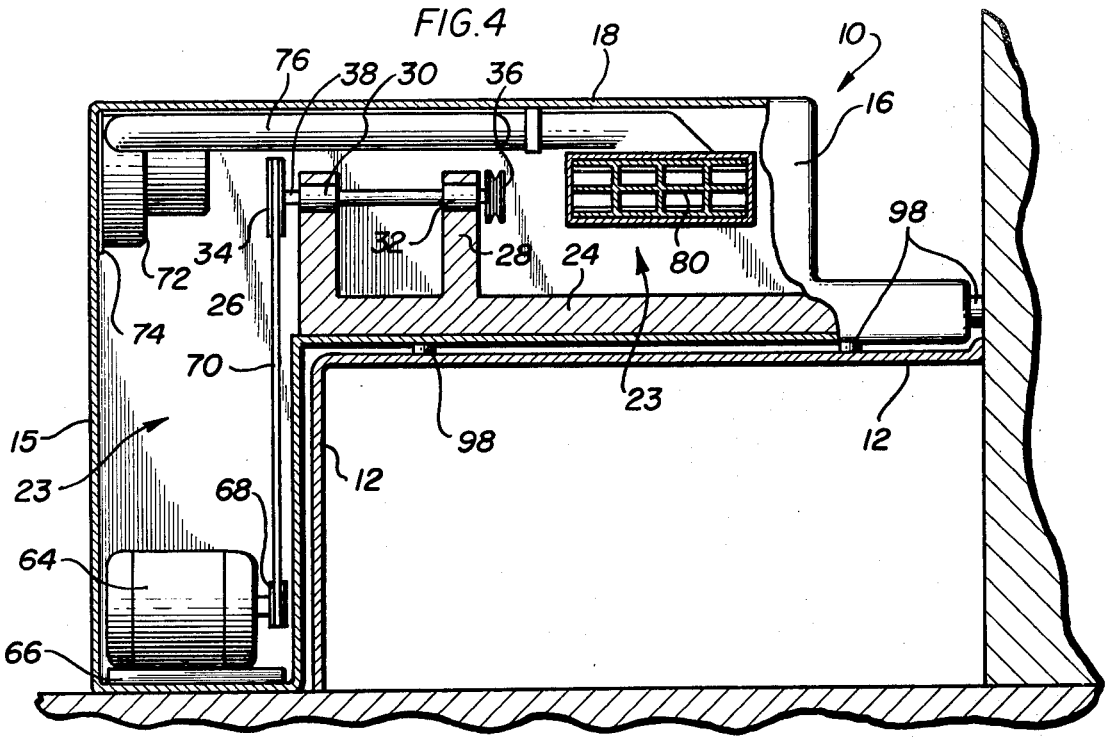
FIG. 4 is a front elevational view partly in section illustrating the construction details of the apparatus of FIG. 1.
Figure 5:
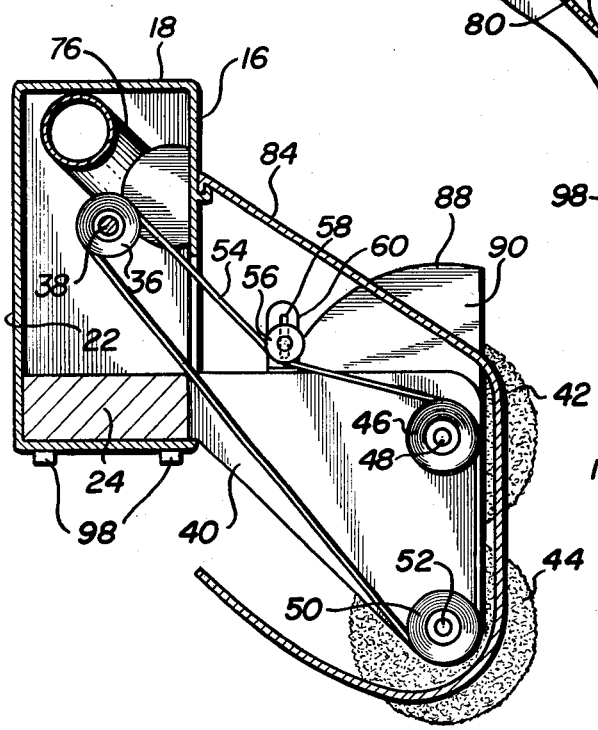
FIG. 5 is a sectional view taken along the section line 5—5 of FIG. 1, illustrating the drive pulley and belt tensioning details.

Mounted within the horizontal portion 16 of the enclosure chamber 23, there is provided a frame 24 (see FIG. 4) including a pair of vertical legs 26, 28 each having respective bearings 30, 32 for rotatably mounting to the frame a pair of driven pullys 34, 36 interconnected by an axle 38. With reference to FIG. 5, it can be seen that the frame 24 further includes a brush mounting portion 40 extending outwardly and depending downwardly therefrom to project within the tub 12. FIG. 5 only illustrates one of the depending portions 40, whereas as can be seen from FIG. 3, an upper roller brush 42 and a lower roller brush 44 are rotatably mounted between a pair of such depending portions 40. An upper pulley 46 is mounted on a shaft 48 with the shaft connected to the upper roller brush 42 and mounted with suitable bearings on each of the depending portions 40. A similar driving connection is provided for the lower pulley 50 and shaft 52 is connection with the lower roller brush 44. An endless drive belt 54 is coupled to each of the pulleys 36, 46 and 50 with the tension in belt 54 being adjustable by means of the idler and tension adjustment pulley 56. Positioning of the pulley 56 in a slot 58 of bracket 60 enables adjustable tensioning of the belt 54. The roller brushes 42 and 44 are formed of a soft, absorbent material preferably lamb's wool so that water may be picked up by the lower brush and transferred to the upper brush as is more particularly described hereinafter.

Figure 6:
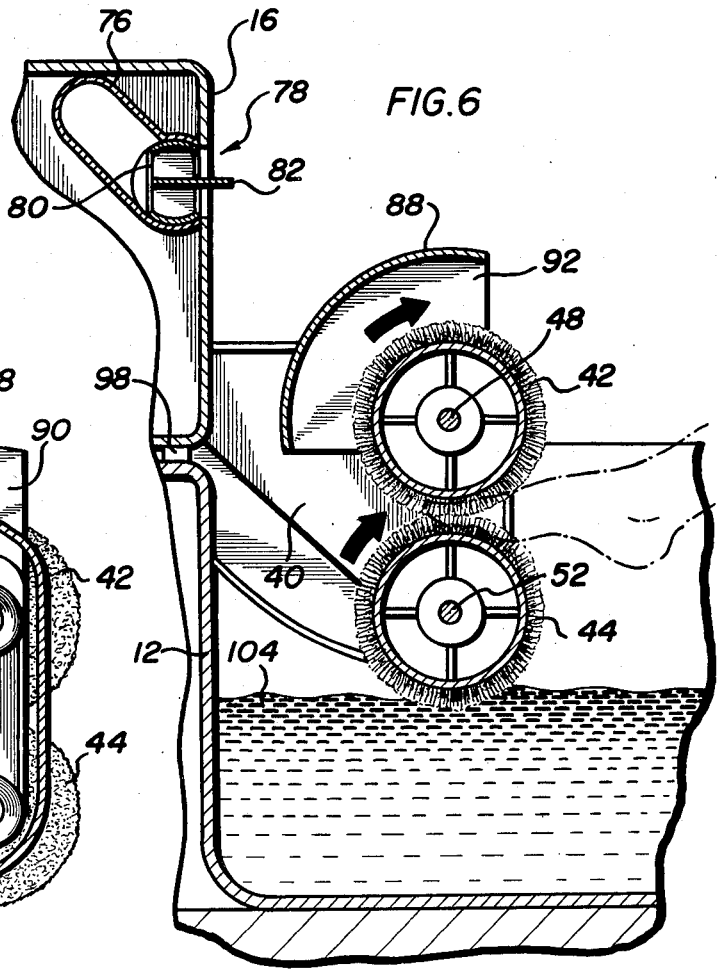
FIG. 6 is a sectional view taken along the section line 6—6 of FIG. 3 illustrating the washing and massaging brushes in operation.

A motor 64 is mounted on base 66 within the vertical portion 14 of enclosure chamber 23 at the bottom thereof and includes a pulley 68 rotatably driven by the motor. Drive belt 70 interconnects pulley 68 with pulley 34 for drivingly rotating pulley 36, belt 54 and the coupled pulleys 46, 50 so as to rotate the roller brushes 42, 44 in a clockwise direction as shown in FIG. 6. FIG. 6 also illustrates the distance between the mounting position of axle 48 of upper roller 42 and of axle 52 of the lower roller 44. In particular, it may be noted that the mounting of the roller brushes is such that the nap of each brush just barely meets at the common tangent line which is aligned between the axles 48, 52. Furthermore, with reference to FIG. 6, the distance between the base and the end of the nap on each of the roller brushes 42, 44 in the mounted position shown in FIG. 6 is about one to one and one half inches -- sufficient to insert the toes or hands of a user in order to obtain cleaning or massaging of both the top and bottom surfaces thereof.

A heater and blower 72 including an electric heater element is mounted by any suitable means such as the screws 74 to the vertical side wall 15 of the enclosure. The heater-blower 72 is coupled by means of an air duct 76 to an aperture forming an outlet 78 in the enclosure wall portion 16. Means are provided at the outlet 78 for varying the direction of the heated air emanating from the duct 76, such means comprising for instance, a rotating louver 80 which may be rotated at the outlet 78 to variably direct the heated air in the desired directions by rotating an adjusting tab 82. As is most readily shown with reference to FIG. 2, the location of the heated air outlet 78 is to enable the user to readily dry his or her hair while simultaneously cleaning other parts of the body. The user may also find the heated air beneficial for relieving stiff necks, sore muscles, and otherwise where the application of heated air is beneficial. It is to be understood of course that the heated air outlet 78 in the enclosure portion 16 can as well be located at other positions. For example, with reference to FIG. 6, the heated air outlet may be located at a lower position so as to direct the heated air somewhat between the upper roller brush 42 and the lower roller brush 44.

A pair of shrouds 84, 86 which may be removably mounted from the enclosure wall 16 by means of clips are utilized for shielding the respective sides of the roller brushes 42 and 44 to prevent water from splashing outwardly outside of the confines of the tub. Similarly, an arcuate top shield 88 includes opposing sides 90, 92 projecting downwardly for pivotal mounting on axle 48. The top shield 88 may thus be rotated to prevent any upward splashes.

Figure 3:
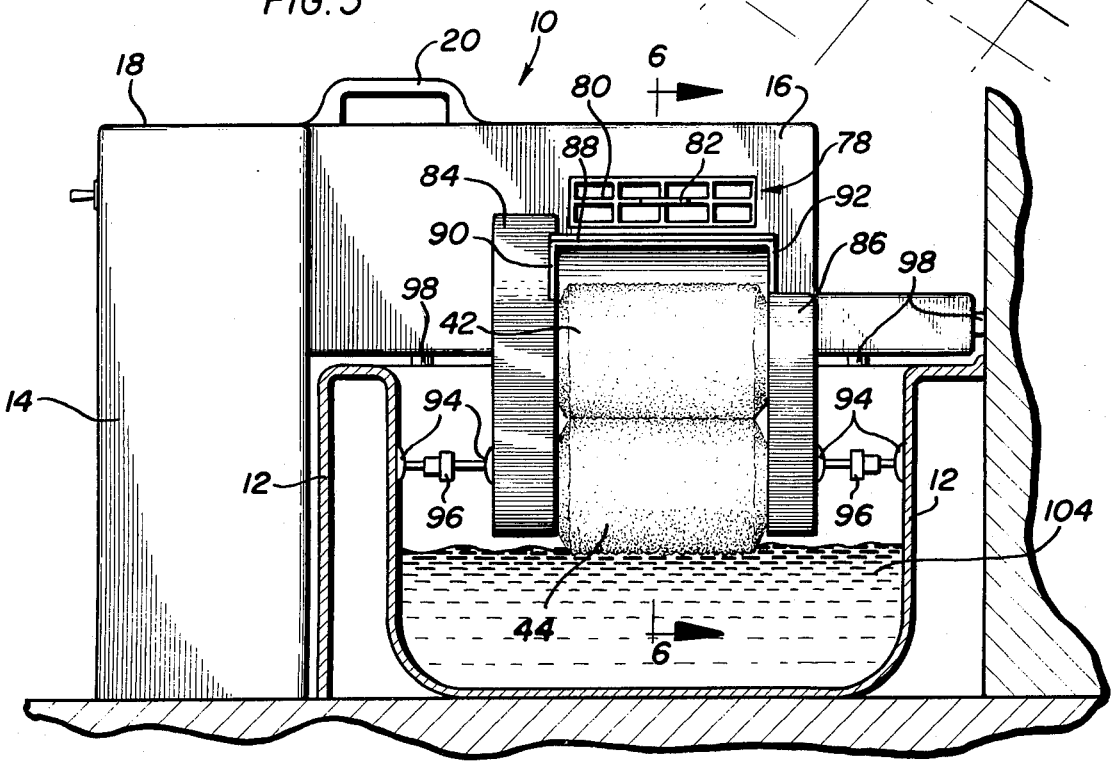
FIG. 3 is a front elevational view of FIG. 2 with the bathtub in section.

Locking means are provided for steadying the portable unit 10 when placed in position on the tub 12. Such means include a pair of suction cups 94 interconnected by means of an adjustable turnbuckle 96 such that when the unit 10 is positioned on the tub 12 as shown in FIG. 3, the locking means can be inserted between the respective shrouds 84, 86 and the inner surfaces of the tub 12 and the turnbuckle 96 adjusted to maintain the suction cups 94 in locking engagement on the respective surfaces. Also, to aid in maintaining the unit in position, there is provided a series of rubber bumpers 98 on the bottom wall of the enclosure to mount the unit in non skidding engagement with the top surfaces of the tub as shown in FIG. 3. Another rubber bumper 98 may also be provided at the side wall of the enclosure so as to form a resilient bumper against one wall of the bathroom as shown in FIG. 3.

For ease in construction the portable unit 10, the enclosure walls 14, 15, 16 and 18 and all other walls except the back wall 22 (see FIG. 5) can be formed of a unitary, one-piece structure, of plastic material, with the operating units previously described being mounted in position within the enclosure. The back wall 22 which may also be formed of plastic material can be put into position using any convenient detachable means for mounting it to the other portions of the enclosure. This also enables easy access to the interior of the portable unit 10 when required for any maintenance by simply removing the back wall 22 and thereby exposing the interior chamber 23 of the enclosure. A multi-position switch 100 can be suitably wired to electrically interconnect electrical power from the power plug 102 to the motor 64 and heater-blower 72 (including an electrical heating element) such that the motor and the heater-blower can be operated independently of each other or simultaneously.

In operation, the portable unit 10 can be readily carried by the handle 20 and placed in position with the vertical portion 14 adjacent the side of the tub 12 and with the horizontal portion 16 overlying one end of the tub at the top thereof so that the bumpers 98 firmly engage the upper tub surface. The locking means for each of the shrouds 84, 86 can then be put in place and the unit secured in position by adjustment of the turnbuckles 96. The power plug 102 can then be inserted into any suitable electrical outlet in the bathroom and the switch or switches 100 operated to select the desired operation of the unit. A level of water 104 is then placed in the tub so that the nap portion of roller brushes 44 just engages the top surface of the water as shown in FIG. 6. In a normal size bathtub the level of water in the tub amounts to about 7 inches so as to obtain the preferred water level as shown in FIG. 6.

It has been found that with the water level just barely engaging the naps of the roller brush 44 as shown in FIG. 6, that of the total amount of water transferred upwardly by the naps of the lower roller brush 44, about half will be transferred to the upper roller brush 42 so as to equalize the cleaning operation. It is understood of course that if the water level is too high the brushes quickly become saturated and undesirably could remain so for their entire revolution; whereas if the water level is too low, this is also undesirable since either none at all or not enough water will be absorbed and transferred from the lower brush to the top brush 42 to obtain the desired cleaning operation. The unit 10 may then be used for washing or massaging by utilizing the brushes 42, 44 as shown by the user illustrated in dashed lines in FIGS. 2 and 6. In conjunction therewith, the heater-blower 72 of course may be operated to supply heated air through the adjustable louvers 80 and at the outlet 78. Alternatively, the heated air through the louvers 80 may be utilized without operation of the roller brushes if desired, such as for drying hair.

After use of the portable unit 10, it may be left in its position as shown on the tub 12. However, when it is desired to remove the unit, this can be readily accomplished by unplugging the power plug 102 from the electrical outlet, loosening the turnbuckles 96 and removing the suction cups from their locking positions, and grasping the handle 20 for carrying the unit to a desired storage position.

Various alternative constructions may be utilized incorporating the principles of the present invention. As indicated previously, the heated air outlet 78 in enclosure wall 16 may be located somewhat lower so as to direct heated air towards the roller brushes 42, 44. In addition, a flange rigidly affixed to the respective shrouds 84, 86 can be used to permanently mount one end of the locking means to the shrouds. The portable unit could then be locked in position by adjusting the turnbuckles 96 to position the suction cups at the free end against the tub 12 surfaces. When removed from the bathtub, the unit may be placed on a stand for storage or operated from the stand for the application of medication and heat with the rotating massaging brushes in the treatment of stiffness, sore muscles, and general aches and pains.

The foregoing detailed description has been given for clearness of understanding only, and no unnecessary limitations should be understood therefrom as modifications will be obvious to those skilled in the art.

What is claimed is:

1. Portable body washer and massager apparatus for use with a bathtub, said apparatus comprising:

an L-shaped enclosure defining an enclosed chamber therewith, said enclosure including;

a first enclosure portion extendable horizontally across the top of said bathtub at one end thereof, a second enclosure portion depending downwardly from said first portion and extendable vertically adjacent a side wall of said bathtub, and a top enclosure portion interconnecting said first and second portion, said top portion including a handle mounted thereon for readily removing said apparatus from said tub;

an elongated frame mounted coextensively with the bottom of said first enclosure portion, said frame including a pair of spacially separated extensions depending outwardly and downwardly from said elongated frame so as to project within said tub upon emplacement of said apparatus thereon;

a pair of roller brushes rotatably mounted between said pair of spacially separated extensions in substantially vertical alignment with respect to each other;

driven pulley means mounted to said elongated frame at one end thereof adjacent said second enclosure portion, and a first endless belt drivingly connecting said driven pulley means to said pair of roller brushes;

a motor mounted within said enclosed chamber at the bottom of said second enclosure portion substantially isolated from water splashes, said motor adapted for selective connection to an electrical power source;

a driver pulley rotatably mounted to said motor; and a second endless belt interconnecting said driver pulley and said driven pulley means for rotating said roller brushes during operation of said motor.

2. A portable body washer and massager apparatus as claimed in claim 1, including:

a heater-blower mounted within said enclosure, including a heater element for generating heated air; and an air duct coupling said heated air from said heater-blower to an outlet in said first enclosure portion.

3. A portable body washer and massager apparatus as claimed in claim 2, including adjusting means mounted at said outlet for varying the direction of said heated air exiting said outlet.

4. Portable body washer and massager apparatus for use with a bathtub, said apparatus comprising:

an L-shaped enclosure defining an enclosed chamber therewithin substantially isolated from water splashes during use of said apparatus, said enclosure including;

a first enclosure portion extendable horizontally across the top of said bathtub at one end thereof, a second enclosure portion depending downwardly from said first portion and extendable vertically adjacent a side wall of said bathtub, and a top enclosure portion interconnecting said first and second portion, said top portion including a handle mounted thereon;

a frame mounted at the bottom of said first enclosure portion, said frame including a pair of spacially separated extensions depending outwardly and downwardly from said elongated frame so as to project within said tub upon emplacement of said apparatus thereon;

a pair of rollers including brushes rotatably mounted between said pair of spacially separated extensions in substantially vertical alignment with respect to each other;

driven pulley means mounted to said frame including a first endless belt drivingly connecting said driven pulley means to said pair of roller brushes;

a motor mounted within said enclosed chamber and adapted for selective connection to an electrical power source;

a driver pulley rotatably mounted to said motor;

a second endless belt interconnecting said driver pulley and said driven pulley means for rotating said roller brushes during operation of said motor; and locking means mounted between each of said spacially separated extensions and the inner surfaces of said tub upon emplacement of said apparatus thereon for securely maintaining said apparatus in position, said apparatus being readily removable from said tub.

5. A portable body washer and massager apparatus as claimed in claim 4, wherein said locking means includes suction cups for grippingly engaging the inner surfaces of said tub, and means for adjusting the position of said suction cups with respect to said spacially separated extensions.

6. A portable body washer and massager apparatus as claimed in claim 5, wherein said locking means includes one end thereof opposite to said suction cups rigidly mounted to said apparatus.

7. A portable body washer and massager apparatus as claimed in claim 4, including:

a heater-blower mounted within said enclosure, including an electrical heating element for generating heated air; and an air duct coupling said heated air from said heater-blower to an outlet.

8. A portable body washer and massager apparatus as claimed in claim 7, including adjusting means mounted at said outlet for varying the direction of said heated air exiting said outlet.

9. A portable body washer and massager apparatus as claimed in claim 4, including means for adjusting the tension of said second endless belt.

10. A portable body washer and massager apparatus as claimed in claim 4, including means for mounting said rollers so that the outermost portion of the brushes are barely touching each other.

* * * * *